US005192159A

United States Patent [19]

Higginson

[11] Patent Number: 5,192,159

[45] Date of Patent: Mar. 9, 1993

[54] SECURITY POST

[75] Inventor: Barry Higginson, 281 Newton Road, Lowton, Warrington, Cheshire, England

[73] Assignees: Barry Higginson; Arthur Kirkham et al. Crook, both of Cheshire, England

[21] Appl. No.: 673,529

[22] Filed: Mar. 22, 1991

[51] Int. Cl.[5] ..... E01F 9/00

[52] U.S. Cl. ..... 404/11; 403/109; 49/49; 49/131

[58] Field of Search ..... 404/6, 11-13; 403/83, 109; 52/298; 49/35, 49, 131

[56] References Cited

U.S. PATENT DOCUMENTS

| | | | |
|---|---|---|---|
| 2,315,516 | 4/1943 | Gray | 52/298 X |
| 3,451,164 | 6/1969 | Kappelman | 49/35 |
| 3,564,769 | 2/1971 | Wilson et al. | 49/35 |
| 3,660,935 | 5/1972 | Boots | 49/35 |
| 3,698,135 | 10/1972 | Boots et al. | 49/35 |
| 4,003,161 | 1/1977 | Collins | 49/35 |
| 4,715,742 | 12/1987 | Dickinson | 404/6 |
| 4,862,656 | 9/1989 | Kelly | 52/298 X |
| 5,033,905 | 7/1991 | Schmidt et al. | 404/6 |

*Primary Examiner*—Ramon S. Britts
*Assistant Examiner*—Roger J. Schoeppel
*Attorney, Agent, or Firm*—Nies, Kurz, Bergert & Tamburro

[57] ABSTRACT

A security post to be located within an entry to control vehicular access and comprising a tubular member (10) installed below ground with its upper end generally level with the surface, and having a hinged lid (14). A post (17) is slidable vertically within the tubular member (10) and is lockable by means of a key operated lockable handle (18, 19) which rotates to locate a locking bar in one of two vertically spaced slots (15, 16) to lock the post in a lowered or raised position whereby the post may be stowed away below ground when not required.

11 Claims, 4 Drawing Sheets

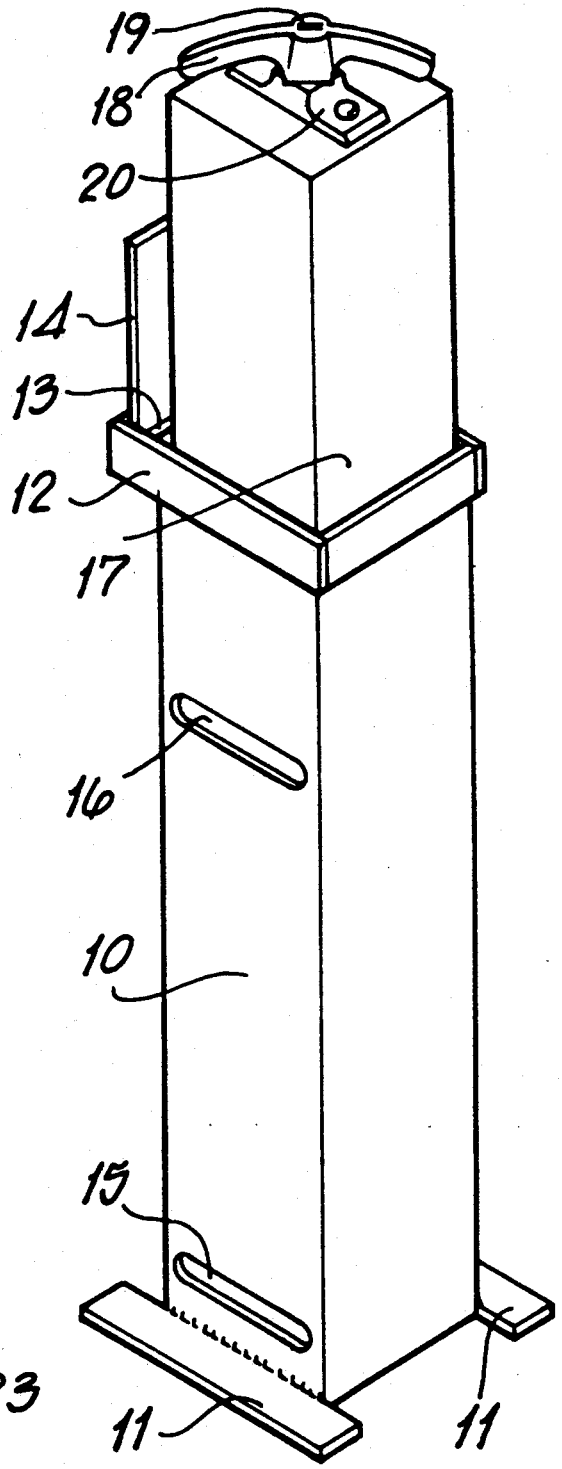
FIG.1
FIG.4
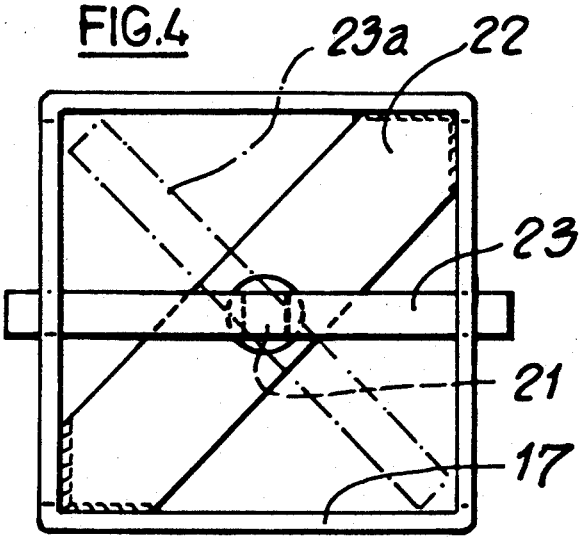

SECURITY POST

THIS INVENTION concerns a security post to be located, for example, within an entry to control vehicular access.

In locations such as private car parks there is often found a "retractable" post which may be lowered to permit vehicular access and then raised and locked to prevent access by unauthorised vehicles. Known devices of this kind consist of a post pivotally connected at its base to a fixed member so that it may be laid down flat against the ground to allow a vehicle to pass over it. The post is then raised to its upright position where it is locked by, for example, a pin passing through the post and the fixed base member to prevent further pivotal movement until the pin is removed.

A disadvantage of this kind of security post is that it is exposed to damage by the running over of heavy vehicles, and to vandalism, since it is permanently located above ground.

An object of the present invention is to provide a security post which in its inoperative or lowered position is locked so as to be inaccessible and unexposed, and thus it is prevented from becoming damaged.

According to the present invention there is provided a security post comprising a tubular member to be located in the ground with one open end substantially level with the surface, a post slidably located within the tubular member between a first position in which it is at least substantially enclosed within the latter and a second position in which it is upstanding therefrom, means for locking the post in either of said two positions, and a cover for the open upper end of the tubular member.

Preferably, the post is provided with a locking catch which may be operated to become physically engaged with the tubular member in the first or second position of the post, the catch being provided with a key operated lock and a handle to enable the user to grasp the post during its insertion into or withdrawal from the tubular member.

The locking catch conveniently consists of a horizontal cross bar located near the base of the post and rotatably mounted on and with a spindle extending longitudinally of the post and connected to the handle at the top, the cross bar in one position being enclosed within the post and in another position being exposed through a slot therein and thus engageable within one of a pair of slots vertically spaced in the wall of the tubular member.

An embodiment of the invention will now be described, by way of example only, with reference to the accompanying drawings in which:

FIG. 1 is an isometric view of a security post made in accordance with the invention and illustrating a tubular member with the post partially removed therefrom;

FIG. 4 is an underside view of the post;

Figure 2:
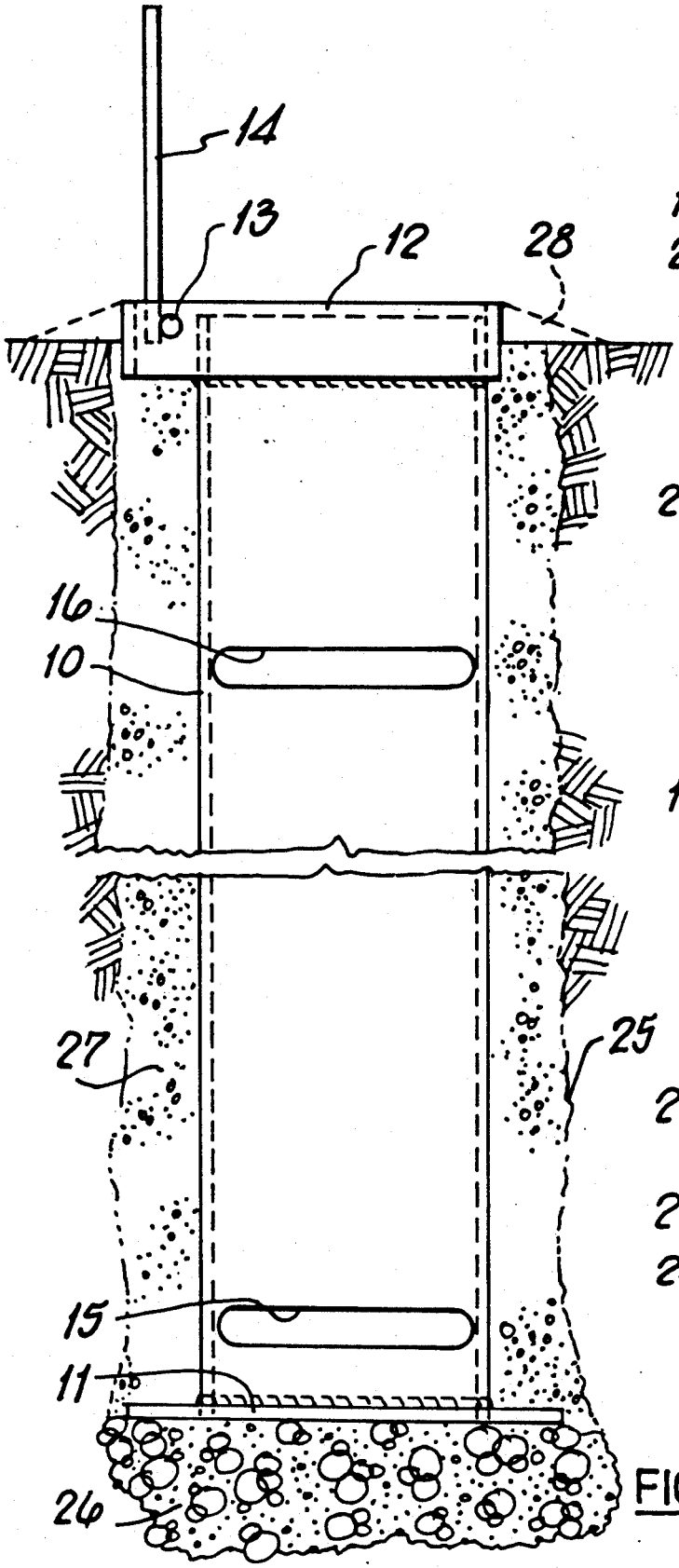
FIG. 2 is a part-sectional view showing the tubular member installed below ground.
Figure 3:
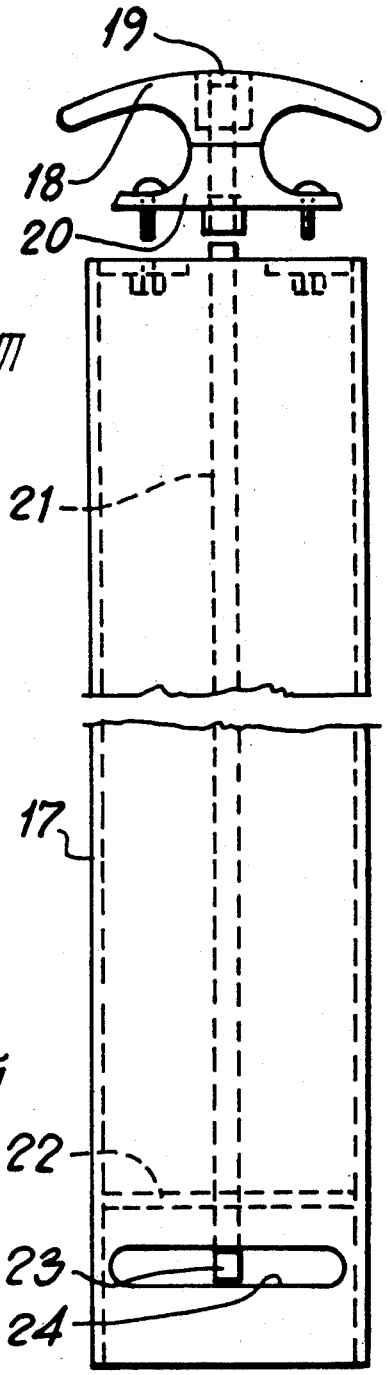
FIG. 3 is a side elevation of a post to be slidably located within the tubular member of FIG. 2.

The security post comprises a square sectioned steel tube 10 having welded to the bottom of two opposed sides thereof a pair of anchor plates 11. The tube 10 is open at its base and at its top which is surrounded by a welded collar 12. Pivotally attached to the collar 12 through a hinge pin 13 is a closure flap 14 which in its closed position rests upon the upper edges of the walls of tube 10.

In the two opposed sides of tube 10 to which plates 11 are attached there are opposed pairs of vertically spaced slots 15 and 16 one near the base of the tube and the other spaced from the top by a distance approximately equal to a quarter of the length of the tube.

Slidably located within the tube 10 is a square sectioned tubular steel post 17. There is sufficient clearance between the post 17 and the inner wall surface of tube 10 to enable the post to be raised and lowered with ease. At the top of post 17 is a rotatable and lockable handle 18 incorporating a key operated lock 19. The handle 18 is rotatable within an upper bearing member 20 bolted to the top of post 17. A spindle 21 extends downwardly from handle 18 to a position close to the base of the post and is located thereat in a lower bearing member 22 in the form of a plate extending diagonally between two corner regions of the post and welded thereto. Welded or otherwise rigidly fixed to the bottom of spindle 21 just below plate 22 is a cross bar 23 which as can be seen in FIG. 4, upon rotation of handle 18 and spindle 21, is caused to move from a position **23*a* in which it is wholly enclosed within post 17 and extends diagonally across the latter, to a position in which it projects outwardly through a pair of opposed slots 24** in the wall of the post.

As can be seen from FIG. 2 the tube 10 is located within an excavation 25 in the ground which is wide enough to receive anchor plates 11 and long enough for almost the entire length of the device to be enclosed below ground and rest upon a bed 26 of aggregate or other drainage medium. Preferably, the top of collar 12 is exposed just above the surface so that when the excavation is back-filled with concrete 27 the entire installation can be finished with a cement ramp 28 around all four sides of the top of collar 12, which prevents damage to the edges thereof and permits drainage of water.

The entire length of post 17 and handle 18 is such that it may be wholly enclosed within tube 10 whereupon cover 14 may be pivoted into its horizontal closed position.

In use, with the device installed in an entry the post may be raised to its uppermost position and handle 18 turned to locate the cross bar 23 within opposed slots 16 in the wall of tube 10. The key may then be removed from lock 19 so that the post remains in the locked position to prevent vehicular access.

When required the device may be unlocked and the post lowered into the tube to enable vehicular access. Preferably, the handle is locked when the post is in its lowered position with bar 23 extending through slots 15. When the device is unlocked, post 17 may be entirely removed from tube 10, for cleaning, painting or replacement.

Prior to installation of the device slots 15 and 16 should be covered by a capping of sufficient depth to accommodate bar 23 but preventing the ingress of concrete when backfilling the excavation.

Whilst cover 14 largely prevents the ingress of rainwater, any which does seep down between post 17 and tube 10 may drain from the latter through the aggregate 26.

Whilst the device has been described for use to prevent vehicular access in car parks and the like, it may have many other applications. For example, a series of such posts installed in a row may be used to create a temporary barrier with chains or the like linking the tops of the posts when raised. In a further example the device may form a retractable standpipe with a hose or other flexible pipe connected to a tap at the top of the post.

In a still further application, the device may be used as a security fixing at each site in a caravan or other trailer park, wherein the top of the post includes a towing ball to which the standard towing bracket on the trailer may be hitched and locked. In this case, there may be no need for a fixed height since the trailer height is determined usually by supporting blocks, so the post may conveniently float freely in the tube.

It is not intended to limit the invention to the above details, many variations such as might readily occur to one skilled in the art being possible without departing from the scope of the invention.

For example, hinged cover 14 may be replaced by a watertight cover which fits over the entire collar 12.

In a further example the tube 10 and post 17 may be of circular or other cross-section in which case cross bar 23 must be retractable from slots 24 in a different manner.

In addition to slots 15 and 16 in tube 10 further slots may be provided at different levels to enable the post to be raised and locked at different heights.

Whilst the device has been described as made in steel, for some applications it may be, for example, of a rigid plastics material.

Figure 5:
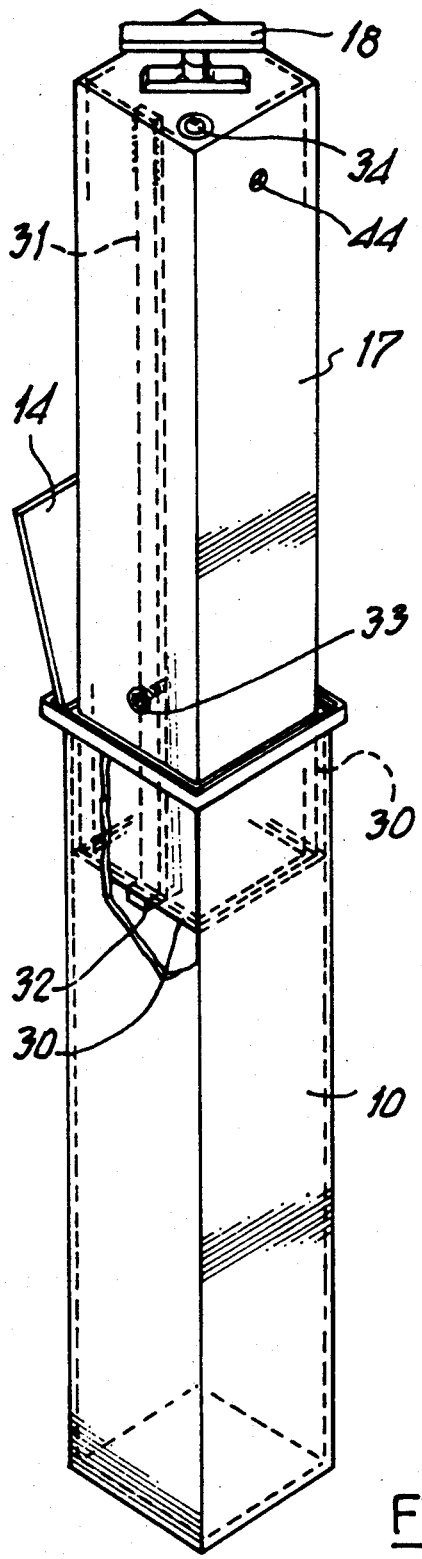
FIG. 5 is a schematic isometric view of a security post illustrating an improvement thereto.

Referring now to FIG. 5 there is schematically shown a post 17 in a raised position in a tube 10. In order to prevent unauthorised removal of the post from the tube a square sectioned sleeve 30 is welded into the top of the tube 10. Also, welded inside the top of post 17 is a vertically disposed bar 31 which terminates below the bottom of the post 17 in a short horizontal cross-member 32. The bar 31 is biased inwardly from the wall of post 17 at its lower end such that member 32 may be wholly disposed inside the bounds of the post. A screw 33 passes through the wall of post 17 approximately one quarter of the way up from the bottom and is threadedly engaged in bar 31. The screw head defines a specially shaped security slot such that a dedicated tool may be used to rotate the screw thus to draw the bar 31 towards the wall of the post until the member 32 protrudes therefrom. In this condition the post cannot be removed from the tube without first operating the security screw 33 so that member 32 will clear the bottom of sleeve 30.

It will be seen in FIG. 5 that the handle arrangement is disposed diagonally across the top of the post to leave room for a spring-loaded barrel lock 34 whose function will now be described.

Figure 6:
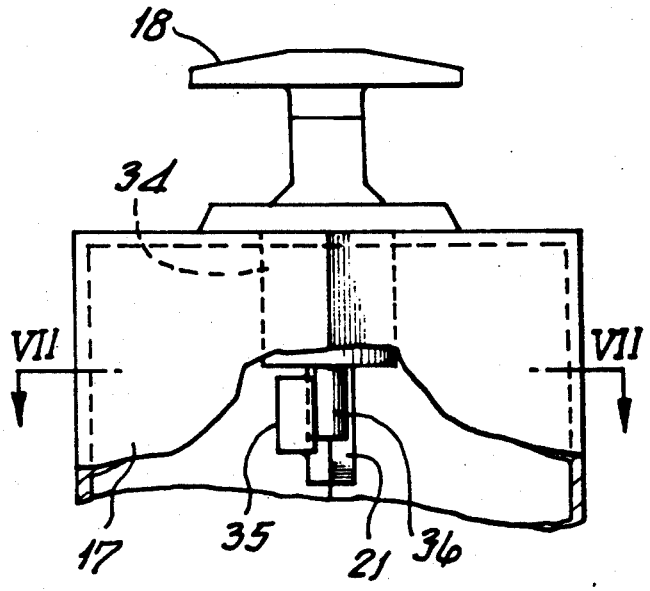
FIG. 6 is a partial elevation of the upper region of the post shown in FIG. 5.
Figure 7:
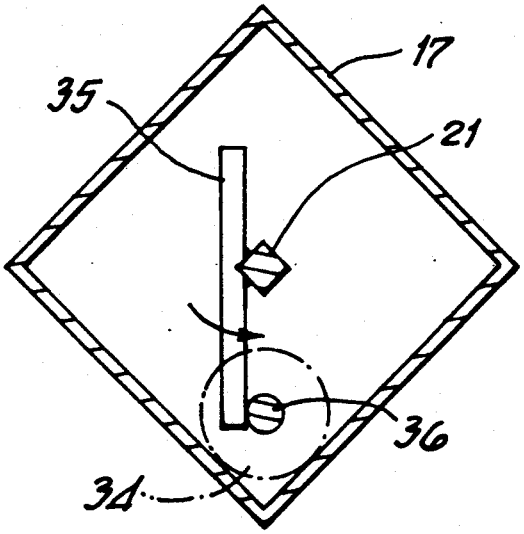
FIG. 7 is a horizontal section taken on lines VII—VII of FIG. 6.

Referring now to FIGS. 6 and 7 the spindle 21 just inside the top of the post has welded to it a cross bar 35 which rotates with the spindle. In FIG. 7 the assembly is shown in the locked position with bar 35 located behind the pin 36 of barrel lock 34. Thus until lock 34 is released, preferably by a key, spindle 21 cannot rotate to unlock the post. Lock 34 may be provided in place of or in addition to the lock 19 in the handle part 18. Preferably, lock 34 is of the kind which is pressed inwardly against a spring to lock and is released by the turn of a key.

Figure 8:
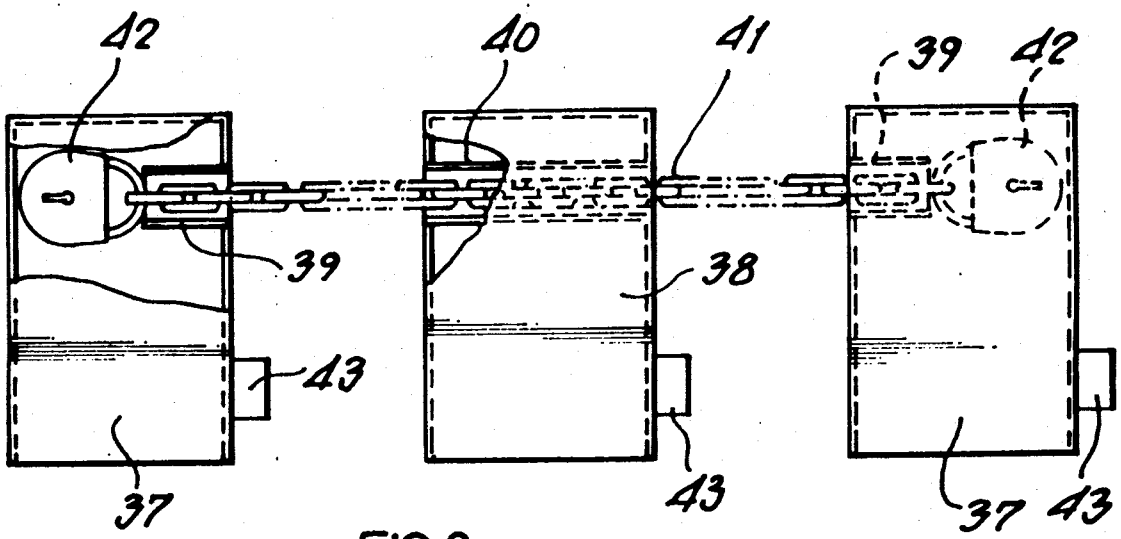
FIG. 8 is a schematic elevation of an assembly of locking caps adapted to be fitted to a line of spaced security posts, and providing a chain cordoned between them.

Referring now to FIG. 8 when a number of security posts made in accordance with the invention are installed in a line, for example across the entrance to a car park then it may be required to extend a cordon between them. To this end, a plurality of capping members 37 and 38 may be provided which will fit over the top of the posts in their raised position. Welded internally of capping member 37 is a short length of open-ended tube 39 whilst capping member 38 has a full width tube 40 welded therein. As can be seen from FIG. 8 it is therefore possible to pass a chain 41 through tubes 40 and 39 and to attach to the ends thereof padlocks or similar locking devices 42. The capping members 37 and 38 may then be placed over their respective security posts, and barrel locks 43 may be provided to retain them. In this case, the appropriate apertures such as shown at 44 in FIG. 5 will be provided in at least two sides of the post to receive the pins of barrel locks 43.

I claim:

1. A security post comprising a tubular member to be located in the ground with its upper open end substantially level with the surface, a post slidably located within the tubular member between a first position in which it is at least substantially enclosed within the latter and a second position in which it is upstanding therefrom, means for locking the post in at least the second of said two positions, a cover for the upper open end of the tubular member, further means within the tubular member separate from the locking means, to prevent unauthorized removal of the post therefrom, and wherein for the two parts comprising the tubular member and the post, the removal prevention means includes an abutment located within one of said parts and a movable bar fixed within the other of said parts and having a member extending outwardly therefrom to engage the abutment, and further including means for enabling authorized disengagement of the bar from the abutment.

2. A security post according to claim 1, wherein said locking means enables the post to be locked selectively in either of said two positions.

3. A security post according to claim 1, wherein said locking means comprises a locking catch which may be operated to engage the tubular member in the first or second position of the post, the catch being provided with a key operated lock and a handle to enable a user to grasp the post for movement relative to the tubular member.

4. A security post according to claim 3, wherein said locking catch consists of a horizontal cross bar located near the base of the post and mounted on a rotatable spindle extending longitudinally of the post and connected to the handle at the top, the cross bar in one position being enclosed within the post and in another position being exposed through a slot therein to engage within one of a pair of slots vertically spaced in the wall of the tubular member.

5. A security post according to claim 1, wherein said cover for the open upper end of the tubular member is pivotally attached at one side thereof and is in the form of a closure flap which in its closed position rests upon the upper edges of the walls of the tubular member.

6. A security post according to claim 1, wherein the tubular member is made from rectangular section steel tube having one or more anchor plates welded to the open bottom end thereof.

7. A security post according to claim 1, wherein said cover fits over the entire upper end of the tubular member to seal the latter.

8. A security post according to claim 4, wherein the slots in said tubular member are capped to prevent the ingress of backfilling materials.

9. A security post according to claim 1, wherein said tubular member and said post are of circular cross-section.

10. A security post according to claim 1, wherein the top of the post includes a towing ball to which a standard towing hitch on, for example, a trailer or caravan may be located.

11. A security post according to claim 1, including a capping member for attachment to the top of the post in its second position and having locking means for preventing unauthorised removal therefrom, said capping member including internal means for attachment of a chain or like cordon to extend between such capping members applied to a plurality of spaced security posts.

* * * * *